US005967325A

United States Patent [19]

McIntire

[11] Patent Number: 5,967,325

[45] Date of Patent: Oct. 19, 1999

[54] PICNIC BOX AND TABLE

[76] Inventor: Randy B. McIntire, 1618 Vagabond Creek Dr., Lake George, Colo. 80827

[21] Appl. No.: 09/127,460

[22] Filed: Jul. 31, 1998

[51] Int. Cl.[6] ..... A45C 11/20

[52] U.S. Cl. ..... 206/541; 206/546; 206/577; 108/14; 220/4.28

[58] Field of Search ..... 206/216, 223, 206/541, 546, 577; 220/4.28, 4.31, 4.33, 23.86; 108/11, 14, 17

[56] References Cited

U.S. PATENT DOCUMENTS

| | | | |
|---|---|---|---|
| 1,002,937 | 9/1911 | Spade | 108/11 |
| 2,258,364 | 10/1941 | Maxwell | 108/14 |
| 4,572,081 | 2/1986 | Copeland | 108/11 |
| 4,969,567 | 11/1990 | Rogers | 220/4.33 |
| 5,535,683 | 7/1996 | Novak | 108/11 |
| 5,551,558 | 9/1996 | Bureau | 206/223 |
| 5,593,058 | 1/1997 | Spencer et al. | 220/4.28 |

*Primary Examiner*—David T. Fidel
*Assistant Examiner*—Luan K. Bui
*Attorney, Agent, or Firm*—G. F. Gallinger

[57] ABSTRACT

A picnic box which can be assembled, then reassembled into a picnic table is disclosed. The picnic box and table comprises: a frame having four corner posts rigidly spaced and permanently held parallel to each other by four rails, each rail extending only between bottom end portions of adjacent corner posts, and two opposite rails having an inwardly extending abutment; two opposite box long side portions removably positioned between corner posts on opposite sides of the frame, and along and above the rails extending therebetween; two opposite box short side portions removably positioned between corner posts on opposite ends of the frame, and along and above the rails extending therebetween; and, a box bottom side portion removably positioned within and above the abutment on the two opposite side rails. The box side portions are adapted with tongue and grooves along peripheral edges so that they may be releasably held within the frame and so that when the frame is inverted they may be interlocked thereon forming a table top. The portable table is lightweight, convenient to carry and use, and promotes picnics, conversation, and romance.

18 Claims, 2 Drawing Sheets

PICNIC BOX AND TABLE

FIELD OF INVENTION

This invention relates to picnic accessories. More particularly this invention relates to a picnic box which can be disassembled, then reassembled into a picnic table.

BACKGROUND OF THE INVENTION

There are a multitude of picnic baskets available with which a lunch may be carried for a picnic. One problem with eating off a tablecloth spread on the ground is that it is not very adequate to set a full glass on. Another problem is that ants also find it quite accessible. A tablecloth is not comfortable to be seated at, or to converse over.

What is needed is a table which would facilitate cutting, drinking, eating, and conversation. A table which could be conveniently carried to a remote location, and then, after use, be packaged so that it could be transported back, ready for reuse.

OBJECTS AND STATEMENT OF INVENTION

It is an object of this invention to disclose a picnic box which can be assembled, then reassembled into a picnic table. It is an object of this invention to disclose an apparatus which facilitates eating from a table in a relatively remote location where a table would not otherwise be available. It is a final object of this invention to disclose a portable table which is lightweight, convenient to carry and use, and which promotes picnics, conversation, and romance.

One aspect of this invention provides for a picnic box and table which comprises: a frame having four corner posts rigidly spaced and permanently held parallel to each other by four rails, each rail extending only between bottom end portions of adjacent corner posts, and two opposite rails having an inwardly extending abutment; two opposite box long side portions removably positioned between corner posts on opposite sides of the frame, and along and above the rails extending therebetween; two opposite box short side portions removably positioned between corner posts on opposite ends of the frame, and along and above the rails extending therebetween; and, a box bottom side portion removably positioned within and above the abutment on the two opposite side rails. The box side portions are adapted with tongue and grooves along peripheral edges so that they may be releasably held within the frame. When the frame is inverted they may be interlocked thereon forming a table top.

Another aspect of this invention provides for a box as above further comprising a vaulted cover which can carry a wine bottle.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
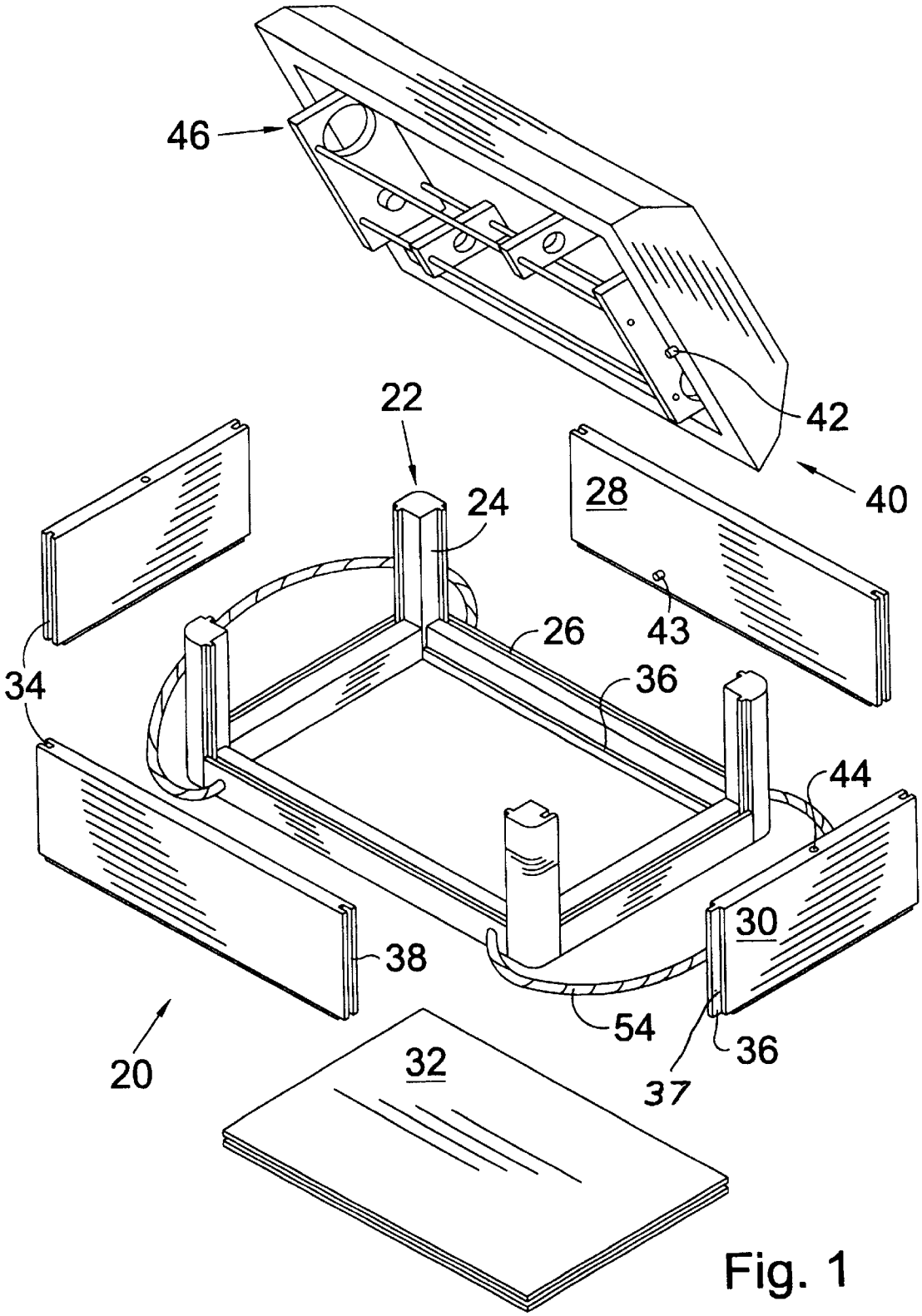
FIG. 1 is a partially disassembled perspective view of a picnic box and table. The side and bottom portions are removed from the frame of the box.

The following is a discussion and description of the preferred specific embodiments of this invention, such being made with reference to the drawings, wherein the same reference numerals are used to indicate the same or similar parts and/ or structure. It should be noted that such discussion and description is not meant to unduly limit the scope of the invention.

DESCRIPTION OF THE INVENTION

Turning now to the drawings and more particularly to FIG. 1 we have a perspective view of a box 20 which can be assembled, and then reassembled as a table comprising: a frame 22 having four corner posts 24 rigidly spaced and permanently held parallel to each other by four rails 26, each rail 26 extending only between bottom end portions of adjacent corner posts 24; two monolithic opposite box long side portions 28 removably positioned between corner posts 24 on opposite sides of the frame 22, and along and above the rails 26 extending therebetween; two monolithic opposite box short side portions 30 removably positioned between corner posts 24 on opposite ends of the frame 22, and along and above the rails 26 extending therebetween; and, a monolithic box bottom side portion 32 removably positioned within and above two of the opposite side rails 26. The box side portions 28,30 are adapted with connection means along peripheral edges 37 thereof so that they may be releasably held within the frame 22.

Preferably the connection means comprises a track on at least one of the side portions of the box and the corner posts 24 of the frame 22, so that the side portion 28,30 may be slid downwardly between the corner posts 24 of the frame 22 to a seated position when the box 20 is assembled. In the most preferred embodiment of the invention the tracks comprise tongues 36 and grooves 38.

Preferably opposite sides of the rail 26 of the frame have an inwardly extending abutment so that the box bottom portion 32 may be downwardly inserted and seated within the rail 26 of the frame 22. In the most preferred embodiment of the invention the abutment comprises a lip 36 extending therealong.

FIG. 1 additionally shows the box 20 having a vaulted top cover 40, adapted to carry a bottle of wine (not shown). A peg 42 having a slight taper to facilitate alignment in the mating holes 44 is used to position and hold the cover 40 on the box 20. A strap or rope 54 may be used to carry the box 20.

Figure 2:
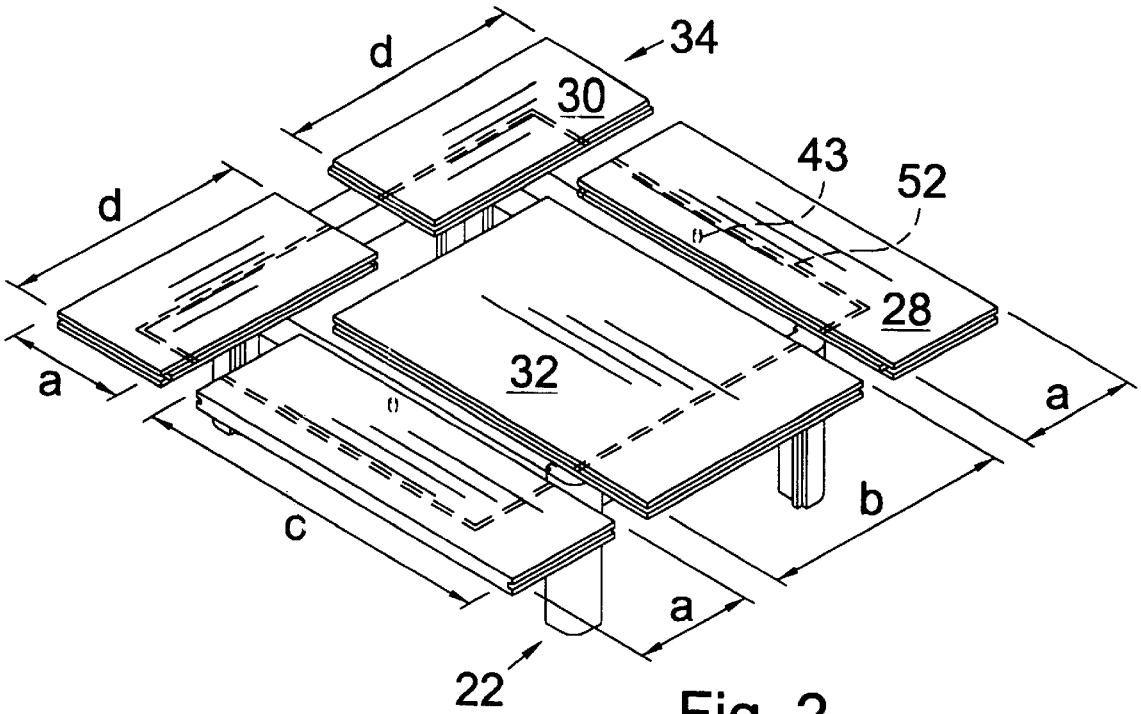
FIG. 2 is a perspective view of the box shown in FIG. 1 without the top cover. The frame of the box is inverted and the side and bottom portions shown thereon are positioned ready to be interlocked to form a table top.

FIG. 2 is a perspective view of the box 20 shown in FIG. 1 without the top cover 40. The frame 22 of the box 20 is inverted and the side portions 28,30 and bottom portion 32 are shown positioned thereon ready to be interlocked to form a table top 34. In the most preferred embodiment of the invention the sides 28,30 and bottom portion 32 of the box 20 interlock to form a square table top 34. One of the peripheral edges of the bottom portion 32 of the box 20 and the sides 28,30 has a groove 38 therealong so that they may be interlocked to form a table top 34. In the most preferred embodiment the long side portions 28 may be interlocked along opposite long sides of the box bottom portion 32, and the short side portions 30 may be interlocked along one end portion thereof to form the assembled table top 34.

In the most preferred embodiment the FIG. 2 additionally shows the under side portion of the table top 34 marked with a groove 52 spaced unequal distances from the different peripheral edges of the table top 34 to guide one assembling the table top 34. FIG. 2 also shows in ghost outline, a positioning peg 43, having a slight taper to facilitate alignment, which is used to position the table top 34 on the frame 22.

Figure 3:
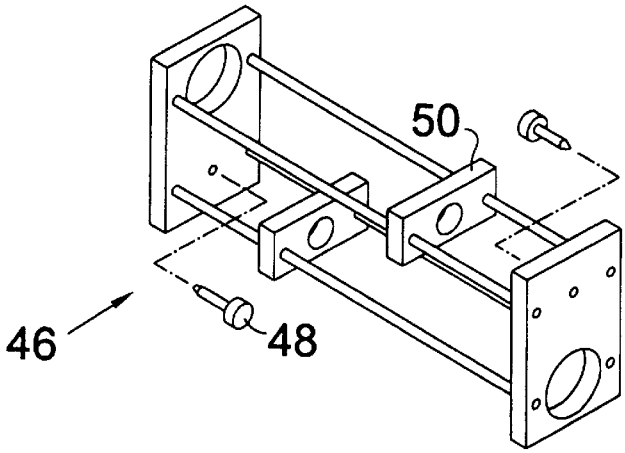
FIG. 3 is an enlarged perspective view of the wine rack shown in the cover of the box in shown FIG. 1.

FIG. 3 is an enlarged perspective view of the wine rack 46 shown in the cover 40 of the box 20 in FIG. 1. The wine rack 46 is releasably positioned in the cover 40 with pins 48 and has a latch 50 which may be slid over the neck of a bottle (not shown). The wine rack 46 is adapted to carry two bottles of wine (not shown).

In FIG. 2*a* is the height of the side portion 28; b is the width of the bottom portion 32; c is the length of the side portion 28 and the bottom portion 32; and, d is the width of the side portion 30. $2a+b$ must equal $2d$. And if the table top 34 is to be square then $2a+b$ must equal $c+a$. Within these algebraic relationships the inventor tried varying dimensions. He tested tentative dimensions against the following additional criteria: 1) was the surface area of the table top 32 adequate?; 2) was the height and shape of the box adequate?; and, 3) could the dimensions take advantage of standard lumber sizes?

It was found that when a was 6", b was 11", c was 17", and d was equal to 11½" all of the above criteria were best satisfied.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A box which can be assembled, and then reassembled as a table comprising:

a frame having four corner posts rigidly spaced and permanently held parallel to each other by four rails, each rail extending only between bottom end portions of adjacent corner posts, and two opposite rails having an inwardly extending abutment;

two monolithic opposite box long side portions removably positioned between corner posts on opposite sides of the frame, and along and above the rails extending therebetween;

two monolithic opposite box short side portions removably positioned between corner posts on opposite ends of the frame, and along and above the rails extending therebetween; and, a monolithic box bottom side portion removably positioned within and above the abutment on the two opposite side rails so that the box bottom portion may be downwardly inserted and seated within the frame;

said box side portions adapted with connection means along peripheral edges thereof so that they may be releasably held within the frame and so that when the frame is inverted they may be all interlocked thereon forming a table top which is wholly and adequately supported by the rails which run centrally under each monolithic portion thereof.

2. A box as in claim 1 wherein the connection means comprises a track on at least one of the side portions of the box and the corner posts of the frame, so that the side portion may be slid downwardly between the corner posts of the frame to a seated position when the box is assembled.

3. A box as in claim 2 wherein the tracks comprise tongues and grooves.

4. A box as in claim 1 wherein the abutment comprises a lip extending therealong.

5. A box as in claim 1 wherein the sides and bottom portion of the box interlock to form a square table top.

6. A box as in claim 5 wherein one of the peripheral edges of the bottom portion of the box and the side portions has a groove, and the other has a mating tongue so that they may interlocked.

7. A box as in claim 6 wherein peripheral edges of the bottom portion have a groove therealong which is adapted to mate with tongues on the side portions of the box so that they may be interlocked to form a table top.

8. A box as in claim 7 wherein the long side portions thereof may be interlocked along opposite long sides of the box bottom portion, and wherein the short side portions thereof may be interlocked along one end portion thereof to form an assembled table top.

9. A box as in claim 8 wherein a positioning peg is used to position and hold the table top on the inverted frame and the cover on the box.

10. A box as in claim 9 wherein the positioning peg has a slight taper to facilitate alignment.

11. A box as in claim 1 further comprising a cover.

12. A box as in claim 9 wherein the cover is vaulted so that it has sufficient internal volume to carry a bottle of wine.

13. A box as in claim 11 wherein said cover carries a wine rack.

14. A box as in claim 12 wherein said wine rack is releasably positioned in the cover with pegs and has a latch which may be slid over the neck of a bottle.

15. A box as in claim 13 wherein said wine rack is adapted to carry two bottles of wine.

16. A box as in claim 1 which is fabricated from wood.

17. A box as in claim 11 wherein the under side portion of the table top is marked to guide one assembling the table top.

18. A box as in claim 17 wherein the guide mark comprises a groove spaced unequal distances from different peripheral edges of the table top.

* * * * *